US007059077B2

(12) United States Patent
Tal et al.

(10) Patent No.: US 7,059,077 B2
(45) Date of Patent: Jun. 13, 2006

(54) HEAVY DUTY MAGAZINE LOADER

(76) Inventors: Guy Tal, P.O. Box 302, Rosh Ha'ayin (IL) 48103; Ran Tal, 48 Brodetzki St., Tel Aviv (IL) 69051

( * ) Notice: Subject to any disclaimer, the term of this patent is extended or adjusted under 35 U.S.C. 154(b) by 72 days.

(21) Appl. No.: 10/489,210

(22) PCT Filed: Sep. 9, 2002

(86) PCT No.: PCT/IL02/00743

§ 371 (c)(1),
(2), (4) Date: Oct. 13, 2004

(87) PCT Pub. No.: WO03/023308

PCT Pub. Date: Mar. 20, 2003

(65) Prior Publication Data

US 2005/0081421 A1 Apr. 21, 2005

(30) Foreign Application Priority Data

Sep. 10, 2001 (IL) ..... 145348

(51) Int. Cl.
*F42B 39/22* (2006.01)

(52) U.S. Cl. ..... 42/88

(58) Field of Classification Search ..... 42/87, 42/88, 89, 90

See application file for complete search history.

(56) References Cited

U.S. PATENT DOCUMENTS 1,786,537 A 12/1930 Holek
2,403,012 A * 7/1946 McPheters ..... 86/47
2,451,521 A 10/1948 Uglum
2,659,173 A 11/1953 Capito
2,834,137 A 5/1958 Kunz
2,981,024 A 4/1961 Skoff
4,291,483 A 9/1981 Musgrave
4,352,254 A 10/1982 Kurt
4,538,371 A 9/1985 Howard
4,574,511 A 3/1986 Csongor (Continued)

FOREIGN PATENT DOCUMENTS

DE 3634119 A1 4/1988
DE 37 20 496 A1 * 1/1989

(Continued)

OTHER PUBLICATIONS maglula Ltd.; Magazine Loader and Unloaders; 1 page; 2004.*

(Continued)

*Primary Examiner*—Stephen M. Johnson

(57) ABSTRACT

A magazine loader comprises a magazine compartment (30), an elongated slideway (14) having a bullet and a case grooves (18, 22), respectively, along its length profiled to receive and retain the distal ends of rounds (50) between them, and a slider (40) slidable in slideway (14). A magazine (60) is positioned in compartment (30) such that its open end is perpendicular and in continuation to slide-way (14), and is leveled to receive rounds (50) slidable in slideway (14). Slider (40) is moved away from magazine (60) and a plurality of rounds (50) are sequentially placed in slideway (14) in and between grooves (18, 22). When all rounds (50) are placed in slideway (14), slider (40) is used to thrust all rounds (50) into magazine (60) with a single quick hand stroke.

23 Claims, 7 Drawing Sheets

U.S. PATENT DOCUMENTS

| | | | | | |
|---|---|---|---|---|---|
| 4,614,052 | A | * | 9/1986 | Brown et al. | 42/87 |
| 4,706,402 | A | * | 11/1987 | Csongor | 42/87 |
| 4,879,829 | A | | 11/1989 | Miller | |
| 5,669,171 | A | | 9/1997 | Sally | |
| 6,810,616 | B1 | * | 11/2004 | Tal et al. | 42/87 |

FOREIGN PATENT DOCUMENTS

| | | | | |
|---|---|---|---|---|
| DE | 3720496 | | | 1/1989 |
| EP | 0 205 661 | A2 | * | 12/1986 |
| EP | 205661 | A2 | | 12/1986 |
| GB | 2 252 608 | A | * | 8/1992 |

OTHER PUBLICATIONS

The BETA Company, www.betaco.com Accessories Item LCMSI0 "Speed Loader M16" Feb. 2004, 1 page.

The BETA Company www.betaco.com Accessories Item LCMP85 "Personal Loader M16" Feb. 2004, page.

www.Vectorarms.com/Accessories/UB1_accessories.htm Item "9mm speed loads 6 rounds at a time . . . " Feb. 2004, 1 page.

* cited by examiner

HEAVY DUTY MAGAZINE LOADER

CROSS-REFERENCE TO RELATED APPLICATIONS

This application claims priority of Israel Patent Application Nr. 145348, filed Sep. 10, 2001.

BACKGROUND OF THE INVENTION

1. Field of Invention

The invention relates to firearms, particularly to an accessory for facilitating loading of firearm rounds into a firearm magazine.

2. Prior Art

Small firearms, including assault rifles and submachine guns, utilize and fire rounds (also known as cartridges or ammunition). A round is a cylindrical body having a rear end and a front and opposite end. The rear part of each round comprises a cuplike case (also known as cartridge), usually of brass, which is filled with an explosive propellant. At its rear or closed end, the case has a rim or flange containing a primer; the opposite end of the case is usually open to receive a bullet, slug, or head, sometimes of lead (optionally jacketed) that is partially inserted into it and held by crimping the case onto the bullet, where the bullet is at the front end of the round.

Another type of round is a 'blank' or 'training' round that has no bullet at its front end; instead the case is crimped at its 'bullet' end to hold in the explosive propellant. Blanks are made for training and practice.

Rounds are held within and fed into the firearm from a magazine, also known as a clip. A detachable magazine has become dominant throughout the world. The term 'magazine' is broad, encompassing several geometric variations, including curved magazines. Most detachable magazines are similar, varying in form and structure, rather than in their general principles of operation.

Magazines usually take the form of an elongated container having a generally rectangular cross-section, which the user attaches to the underside of the firearm. They are commonly made of aluminum alloys, plastic, or steel. They are usually closed on five sides and open on a sixth, and are substantially hollow. The open side has a rectangular end and includes two round-retaining members, known as lips.

Magazines have an internal spring, which urges a follower (a shaped piece of plastic or metal) toward the open end. The follower in turn urges the rounds as a group up against the lips. The lips act as a stop for the rounds so that the force from the follower will not expel them from the magazine. The firearm's chambering mechanism then picks off the rounds individually and transports them to a chamber where a firing pin fires them, under control of the user.

In a magazine rounds are stacked or oriented either in a straight column, or in a staggered (zigzag) fashion, also called double-stacking. Staggered magazines have a higher round capacity than straight-column magazines of the same length. The longitudinal axes of the rounds are substantially parallel and perpendicular to the direction of travel of the spring and follower. Adjoining rounds are oriented in the same direction, i.e., the bullets or front ends of adjacent rounds are next to each other, as are the cases.

Magazines of handguns or pistols contain either straight or staggered column rounds, and usually expose just a single, topmost, round between both lips. Such magazines, with a single topmost round exposed between both lips, are not relevant here.

Magazines of assault rifles and submachine guns, such as the AR15/M16, AK47/74-Kalashnikov, FAL, MP5, G36, Galil, Uzi, etc., all hold staggered rounds throughout. In contrast to handgun magazines, two rounds are exposed between the lips, where at the top of the magazine a lip alternately retain the left and right topmost round, as the staggered rounds are fed up and picked off.

Prior to use, a firearm magazine must be loaded (charged or filled). When the user loads a magazine, it is necessary to depress all previously loaded rounds before an additional round can be inserted. Each time another round is loaded, the user further compresses the spring, requiring more insertion force. When the user fully loads the magazine, the spring is fully compressed and exerts maximum upward force.

Loading magazines is a relatively time-consuming and tedious practice. Much time is required to load a plurality of magazines. This shortens reposing, training, and combat time. In combat circumstances, slow reloading can be life threatening.

Some internal military and police procedures instruct that each magazine be periodically unloaded and reloaded for general inspection and cleaning of the rounds and magazine. Therefore, volume loading of hundreds and thousands of magazines periodically occurs at military and police armories. In addition, volume loading occurs at combat time, military drills, and at shooting ranges throughout the world. In all, users waste immeasurable time in magazine loading.

The common method of loading magazines is the straightforward "push-down" method. The user places one or more rounds longitudinally in parallel with and between the lips of the magazine. Then the user successively forces round(s) inside the magazine, thrusting down the topmost round to slip past the retaining lips, to be locked by them. The user may perform this method with bare fingers. However, the drawbacks are as follows: (1) Using one's bare fingers to force rounds against the spring pressure often is painful, especially where the thumb is repeatedly used. As more rounds are loaded, increased loading force is required against the compressed spring. Pain intensifies if multiple magazines are loaded, if the weather is cold, or if the user loads a magazine with injured fingers. (2) Bare finger loading is slow and cumbersome, especially with an untrained user.

Therefore, since much volume loading is required and bare finger loading is a tedious and painful practice, numerous attempts have been made to provide loaders for quickly loading a plurality of rounds into a magazine. They fall into two categories: (1) accessories for loading a plurality of bound rounds, and (2) accessories for loading a plurality of loose rounds.

In the first category, accessories for loading bound rounds, such as the common set of ten rounds bound with a metal or plastic retainer strip (also called a stripper clip), are shown in the following references: U.S. Pat. No. 4,291,483 to Musgrave, Sep. 29, 1981; U.S. Pat. No. 4,538,371 to Howard, Sep. 3, 1985; U.S. Pat. No. 4,574,511 to Csongor, Mar. 11, 1986; U.S. Pat. No. 4,706,402 to Csongor, Nov. 17, 1987; and U.S. Pat. No. 5,669,171 to Sally, Sep. 23, 1997.

Further, The Beta Company of Georgia shows at its web site:

http://www.betaco.com/cmag_m16_catalog_new.htm a "Speed Loader" (item LCMS10) for loading ten-round retainer strips. They load one strip at a time using a plunger.

However, loaders for bound rounds are irrelevant where loose rounds are available.

In the second category, the following references show accessories for loading a plurality of loose rounds:

U.S. Pat. No. 1,786,537 to Holek, Dec. 30, 1930, describes an apparatus for loading four rounds on each feeder stroke. Such apparatus is therefore inefficient for volume magazine loading. Also it is slow to use, comprises many parts, and is relatively fragile.

U.S. Pat. No. 2,834,137 to Kunz, May 13, 1958, the Howard patent, supra, and a similar loader accessory by IMI Israel, found at the following site:

http://www.vectorarms.com/accessoriesUZI.htm ("SPEED-LOADERS" section, item "9 mm, speed loads") all describe a magazine loader for loading a group of loose rounds into a magazine using the pushdown method. However, these devices are relatively fragile and slow to use, and are inefficient for volume magazine loading.

Further, The Beta Company shows at its site:

http://www.betaco.com/cmag_m16_catalog new.htm (item LCMPP05) a device for loading a plurality, usually five to ten, loose rounds. The user drops rounds into the body through a side hole, and simultaneously presses them into the magazine using a top plunger. Again, these devices are slow to use and are inefficient for volume magazine loading.

U.S. Pat. No. 2,403,012 to McPheters, Jul. 2, 1946, describes a magazine loader for loading a magazine in one stroke. However, this loader comprising many parts, has a hinged lid that must be closed on the rounds, and appears relatively flimsy.

U.S. Pat. No. 2,451,521 to Uglum, Oct. 19, 1948, describes a magazine loader using a vertically reciprocating plunger operatively coupled to a turning crank and a handle for individually loading a round on a turn of the crank. However, this loader comprising many parts, is complex, and is tedious to load.

U.S. Pat. No. 2,659,173 to Capito, Nov. 17, 1953, describes a magazine loader where rounds are serially loaded into a substantially closed container before the user thrusts them into a magazine. However, this loader is uncomfortable to use, comprises many parts, and is not suited for volume magazine loading.

U.S. Pat. No. 2,981,024 to Skoff, Apr. 25, 1961, describes a loader for a tubular magazine comprising a closed container with a spring which forces the rounds out and a lever for releasing the rounds from the container. However, this loader is uncomfortable to use, comprises many parts and is not suited for modern magazines.

U.S. Pat. No. 4,614,052 to Brown et al, Sep. 30, 1986, describes a magazine loader for loading a plurality (usually 15–20) loose rounds in one stroke. However, this loader comprises many parts, has a swingable lid to close on the rounds, and is not sufficiently rugged to sustain prolonged use in military environment. Further, the installed rounds cannot be thoroughly inspected and cleaned while in the loader and before loading.

U.S. Pat. No. 4,879,829 to Miller et al., Nov. 14, 1989, describes a magazine loader comprising a crank for turning and loading rounds. However, this loader comprises many parts and is complex and tedious to use.

EP0 patent 205,661 to Samet et al., Dec. 30, 1986, describes a loader for loading a plurality of rounds into a magazine. However this loader includes many parts, has a swingable lid that closes on the rounds, is uncomfortable to use, and is not sufficiently rugged for field use.

DE patent 3,720,496 to Lembit, Jan. 5, 1989, describes a device for loading multi-shot magazines. However this device includes many parts, is uncomfortable to use, and is not sufficiently rugged.

In sum, while there exist many accessories for facilitating magazine loading, each has one or more drawbacks, including flimsiness, and complexity of construction and use.

OBJECTS AND ADVANTAGES

Several objects and advantages of the invention are to provide (a) a heavy duty volume loader for completely filling a staggered firearm magazine with loose rounds in a single stroke, (b) a device where the rounds can be inspected and cleaned thoroughly prior to loading into the magazine, (c) a durable device that is simple to operate in tough military conditions, and having only one movable part, (d) a device workable with no fatigue to a user's fingers, (e) a low-cost device comprising few parts; and (f) either a variety of such loaders each made to match a specific magazine, or a single loader adaptable to receive a variety of different magazines, or a modular loader comprising a combination of attachable parts for assembly to fit any round and matching magazine combination.

Still further objects and advantages will become apparent from a consideration of the drawings and ensuing description.

SUMMARY

A heavy duty device for fully loading a firearm magazine with rounds in just one stroke comprises, an elongated rounds recess or slideway comprising a substantially flat bottom surface bordered along its length by two sidewalls. Each sidewall comprises a bottom groove along its length. The slideway is adapted to receive a plurality of rounds lying side-by-side on its bottom surface perpendicular to the slideway where the tips of the bullets are in one groove and the rear portion of the cases are in the opposite groove.

On one end of the slideway there exist a magazine recess or compartment for flatly receiving and holding a firearm magazine where its open end faces and in communication with the slideway and is leveled to receive rounds from the slideway. A slider is slidable in the slideway.

A user first fits an empty magazine in the compartment, slides the slider all the way opposite the magazine, then manually inserts loose rounds in the slideway. The rounds are inserted slightly diagonal to the slideway between the sidewalls and then slightly turned to be perpendicular to the slideway where both distal ends of the rounds are in the grooves of the sidewalls. The user crams the rounds toward the magazine as they are placed in the slideway. Once all the rounds are in the slideway they may be visually inspected and cleaned with a dry brush or air pressure. The user then grabs the slider and quickly thrusts the rounds toward the open end of the magazine to insert all the rounds into the magazine. The loaded magazine is then lifted away from its compartment and is ready for use.

DRAWINGS—FIGURES

DRAWINGS—REFERENCE NUMERALS

Figure 1:
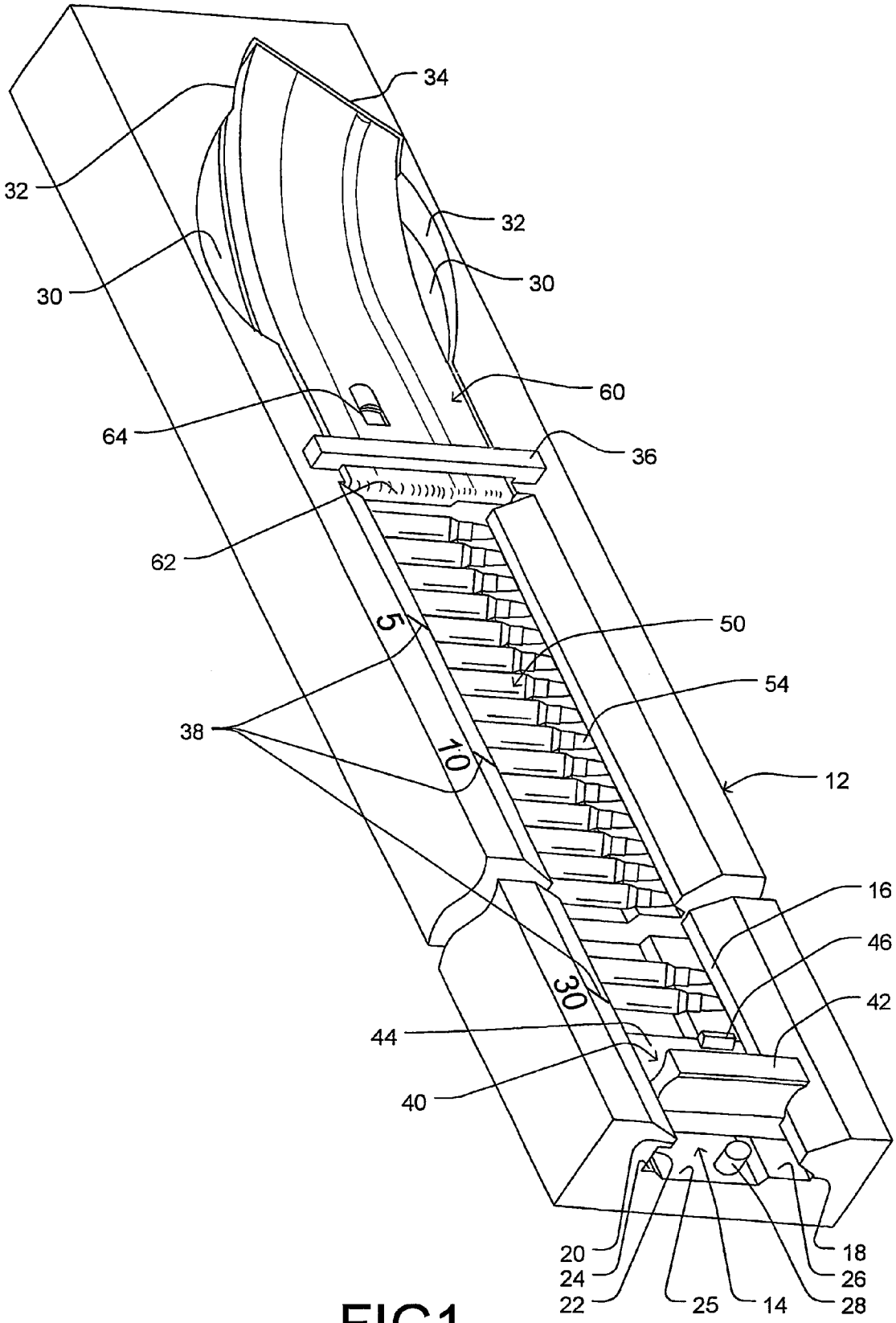
FIG. 1 shows a simplified perspective view of an AR15/M16 type magazine benchloader (BL) with a magazine placed in its compartment and a plurality of rounds in the slideway.

12 main body
12A alternative main body
14 slideway
14A arched slideway
16 bullet sidewall
18 bullet groove
18A groove for blank rounds
20 case sidewall
22 case groove
24 case support
25 recess
26 case neck support
28 slideway stop
28A alternative slideway stop
30 magazine compartment
30A–30E alternative magazine compartment
32 compartment sidewalls
32A–32E alternative compartment sidewalls
34 compartment back wall
34A–4C alternative compartment back wall
36 bridge
37 back extension
38 rounds quantity markings
39 particle exit opening
40 slider
40A arched slider
42 handle
44 plunger
44A arched plunger
46 plunger stop
50 round(s)
50L, 50R round left, right
50A blank round
52 case neck
52A case neck of blank round
54 bullet
60 AR15/M16 30-round magazine
62 magazine lip(s)
64 magazine lock hole or depression
66 Galil 35-round magazine
67 magazine lock protrusion
68 AR15/M16 20-round magazine
70 width adjuster
72 1st length adjuster
74 2nd length adjuster
80 3rd length adjuster
82 4th length adjuster
90 top lock mechanism
92 flexible plate
94 lock tooth
94A alternative lock tooth
96 lock recess
100 bench securing hole
102 chain securing hole
104 carry handle
106 cut void
108 30th round marker
110 magazine pusher

DETAILED DESCRIPTION—FIRST EMBODIMENT—FIGS. 1–3B

FIG. 1 shows a simplified perspective view of a bench loader (BL) adapted to load a common 30-round AR15/M16 curved magazine 60 (NATO STANAG 4179) with matching 5.56×45 mm rounds 50.

The BL comprises three basic parts: a main body 12, a slider or pusher 40, and a bridge or limiter 36. Main body 12 has an upper surface (not numbered) with a magazine recess or compartment 30 extending into the main body from the upper surface at one end. The compartment is sized and shaped to receive and hold magazine 60.

The main body also includes an elongated rounds recess, slideway, or channel 14 extending into the main body from the upper surface at another end of the main body. The slideway is in continuation and communicating with magazine compartment 30.

Bridge 36 is positioned over and across magazine compartment 30 and adjacent slideway 14, and is substantially perpendicular to the length of the slideway. Slider 40 is positioned and retained in slideway 14 and can slide along its length.

Slideway 14 is configured to receive and hold a plurality of side-by-side rounds, oriented such that their bullets 54 or front ends are juxtaposed, where the rounds are substantially perpendicular to the length of the slideway, and in a quantity sufficient to completely fill the magazine. The slideway is defined by two parallel longitudinal sidewalls 16 and 20 and a bottom. An elongated, longitudinal projection, ledge, or rib protrudes from the top of each sidewall so as to create, on each sidewall, a groove or recess along the sidewall's length. Each groove lies under and is partially defined by its overlying elongated projection. Thus right sidewall 16 has a protruding elongated projection at its top that partially defines a bullet groove 18 below the projection and left sidewall 20 has a protruding elongated projection that partially defines a case groove 22 below the projection. Groove 18 is shaped to receive and cover approximately 5 mm of the tips of bullets 54, or front ends, of rounds 50 in the slideway (see also FIG. 2B-C). Groove 22 is shaped to receive and cover approximately 5 mm of the cases end portion (rims) of rounds 50 placed in the slideway.

In the slideway the rounds are supported by two spaced, horizontal, and parallel bottom supports or ledges 24 and 26. Support 24 supports the case's end portion and support 26 preferably supports the case's crimped neck 52 (see also FIG. 2B). The two supports are preferably made of slightly different height such that the longitudinal axes of the rounds are substantially horizontal in the slideway. Supports 24 and 26 and grooves 18 and 22 are smooth so that the rounds will slide smoothly and quietly in the slideway.

In between and slightly below supports 24 and 26 (see also FIG. 2B) is an elongated recess or channel 25 provided to receive sand and dust particles that may drop from dirty rounds in the slideway. Such particles may otherwise obstruct the slidability of the rounds in the slideway.

Magazine compartment 30 is adapted to receive and hold the magazine so that its open end is perpendicular to, substantially centered in, and adjacent one end of slideway 14. The geometry of the compartment allows the magazine to be positioned in one way only, such that its open end is level and faces the slideway. Compartment 30 is defined by sidewalls 32 and compartment back wall 34 which are sized to hold the magazine secure. The compartment includes sufficient open space, such as curved recesses at its sides, to allow the fingers of the user to grab the magazine to release it from the compartment.

Bridge 36 over the edge of compartment 30 prevents the magazine's open end from excessive vertical movement. The bridge can be made of a metal bar or rod for strength and is connected at its distal ends to the main body, preferably by two screws or bolts at the underside of the main body (not shown). The underside of the bridge is less than 2 mm above the magazine.

Slider 40 (best seen in FIG. 3A) is positioned in the slideway and includes a handle 42, a plunger or base 44, and a plunger stop 46 extending up from the plunger. The plunger is sized and profiled to fit between grooves 18 and 22 on two of its sides while sliding on supports 24 and 26. Handle 42 of the slider is perpendicular to the plunger and allows a user to hand grasp the slider.

Slider 40 is confined in its travel between bridge 36 on one side of the slideway, where the handle will engage the bridge, and by a slideway stop 28 on the opposite side of the slideway, where the stop engages the rear side of plunger 44. Stop 28 is a protrusion in the slideway level with the plunger of the slider. Alternatively it can be an extension of the main body into the slideway. Hence, the slider is retained in the slideway after the bridge is assembled, and cannot slide off.

Figure 2A:
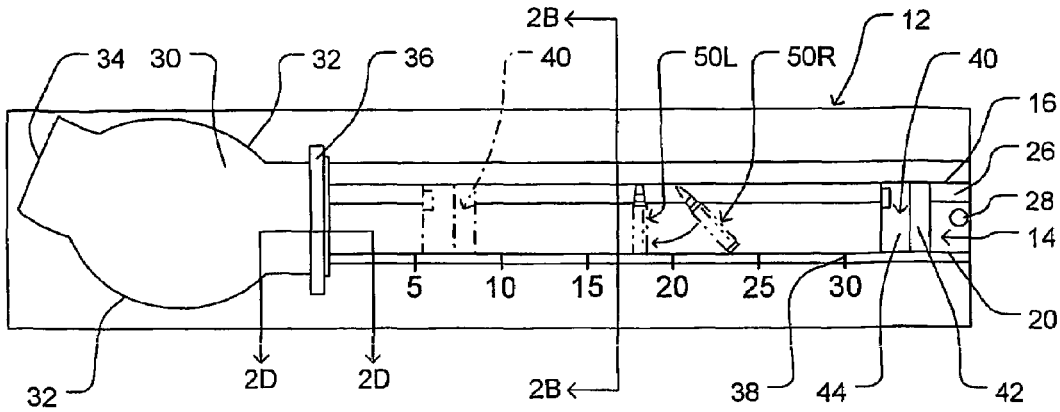
FIG. 2A shows a top view of the BL of FIG. 1 with no magazine and rounds.
Figure 2B:
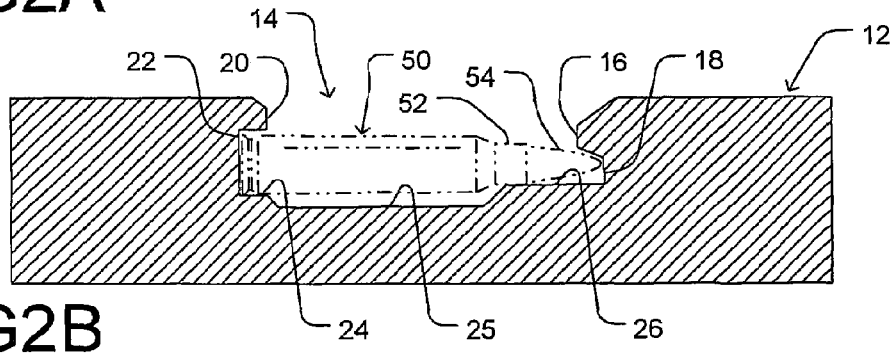
FIG. 2B shows a width cut view of the slideway holding a common round.

FIG. 1 and FIG. 2B show that the upper edges (not numbered) of the slideway's sidewalls 16 and 20 are inclined toward the slideway to provide a lead-in for guiding and facilitating placing a round in the slideway.

Calibrated quantity markings 38 are spaced along the inclined edge of sidewall 20 for assisting the user to determine the number of rounds in the slideway. Preferably, the marks are calibrated at five-round increments up to 30 rounds and have a contrasting color.

The overall size and shape of the BL are defined by the type of magazine for which it is adapted to and the maximum number of rounds to be loaded. Its size is shown in proper proportion to the common AR15/M16 magazine 60.

FIG. 2A shows a top view of the BL of FIG. 1 where slider 40 is close to the far right-hand side and with no magazine installed. The slider is also shown moved somewhat toward the magazine, as shown by the phantom lines.

FIG. 2A further shows an angled round 50R placed down and between sidewalls 16 and 20. The same round is also shown at 50L turned slightly clockwise (CW) to be perpendicular to the slideway and hence covered and retained at its distal ends inside grooves 18 and 20 (see also FIG. 2B).

FIG. 2B shows a width-cut view of slideway 14 illustrating round 50 inside and perpendicular to the slideway and thus held at its distal ends by grooves 18 and 22. The round is supported by support 24 at its case end and by support 26 at its case neck 52. Hence, when the round(s) is perpendicular to the length of the slideway its distal ends are inside the grooves, thus being vertically bound. The round(s) has some vertical freedom in the grooves, and some horizontal freedom (left or right movement as illustrated in FIG. 2B) to allow it to slide in the slideway.

FIG. 2B further shows recess 25 below the round and between the two rounds supports.

Figure 2C:
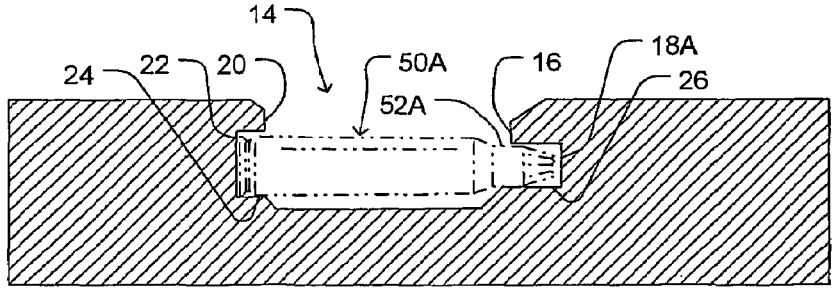
FIG. 2C shows a width cut view of a slideway adapted to hold blank rounds.

FIG. 2C shows a width-cut view of an optional slideway 14 adapted to receive blank or training rounds 50A. The front end of such round usually having extended case neck 52A that is crimped to a close. Sidewall 16 now comprises a groove 18A that is sized and shaped to receive such front ends of blank rounds within. The rest of the BL is unchanged.

Figure 2D:
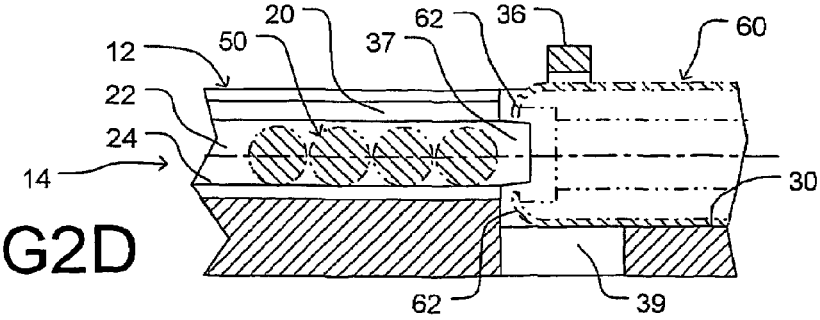
FIG. 2D shows a length cut view portion of the slideway and a cut view portion of the magazine.

FIG. 2D shows a cut-view portion of slideway 14 (looking toward sidewall 20) and a few cut rounds, with magazine 60 lying in compartment 30. The magazine's open end is positioned close to the slideway. The rounds are level in the slideway and centered between lips 62 of the magazine for making their entrance to the magazine symmetrical. A back extension 37 of groove 22 slightly extends in and between the rear of the magazine's lips for continuously positioning rear end of the rounds or cases relative to the magazine so their path inside will be continuous and uninterrupted. A similar extension (not shown) of groove 18 slightly enters the front end of the magazine for the same purpose.

FIG. 2D further shows a cut view of bridge 36, which limits vertical movement of the open end of the installed magazine. This is desirable during loading where the magazine is forced upward, away from its compartment as the rounds are thrust into the magazine. Also shown is a particle exit opening 39 in the bottom of compartment 30 located at the slideway's end for sand and dust particles to be brushed into from the slideway for keeping the slideway and compartment clean.

Figure 3A:
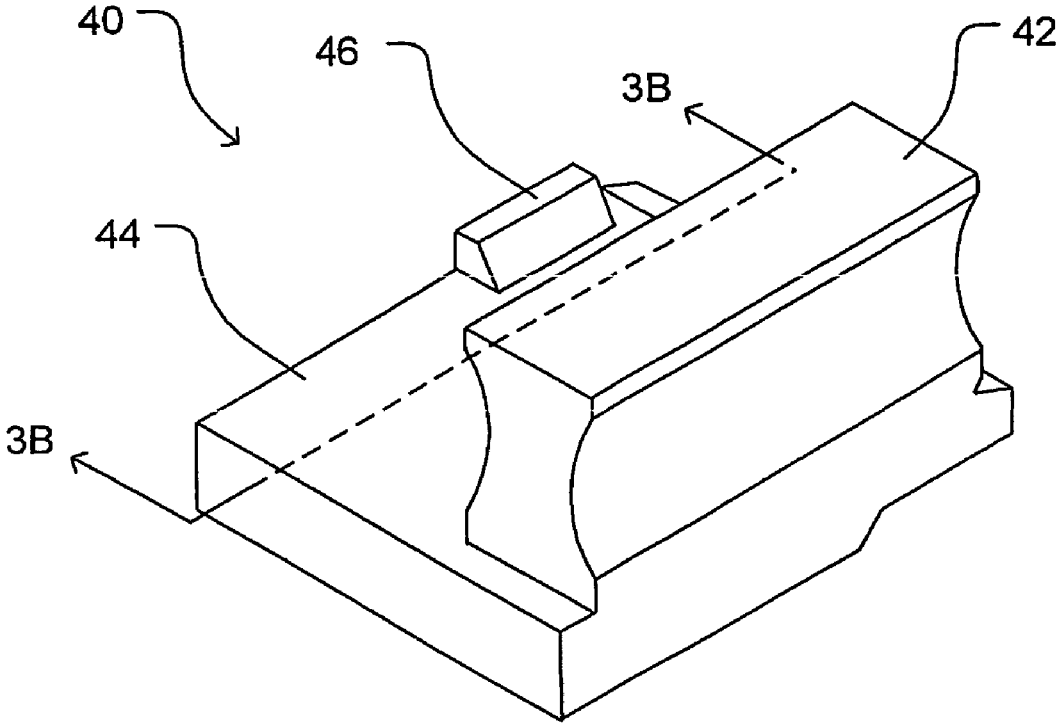
FIG. 3A shows a simplified perspective view of a slider.

FIG. 3A is a simplified perspective view of slider 40. Handle 42 of the slider is sized to be comfortably grabbed by the user, and to fit between the two sidewalls. Plunger 44 is part of the slider. It includes a plunger stop 46 for engaging a portion of the magazine's open end for preventing the plunger from traveling inside the magazine between the lips.

Figure 3B:
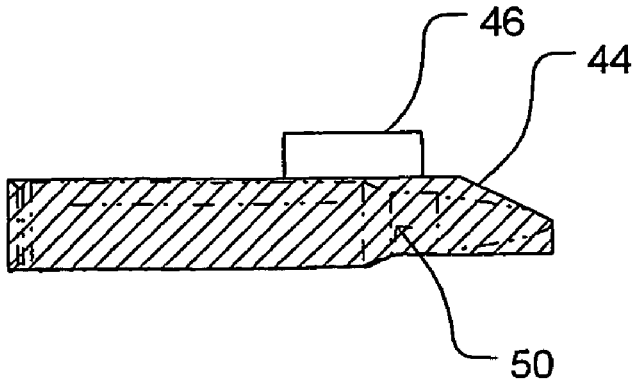
FIG. 3B shows a cut view portion of a plunger of the slider.

FIG. 3B shows a sectional view portion of plunger 44. It substantially conforms to the outline of round 50 (shown in phantom lines). Plunger 44 is shaped to fit in and between the grooves and slide along the supports of the slideway, just as a round would.

The BL is preferably manufactured by using computer numerical control (CNC) machining a block of material, by plastic injection molding, or by metal casting. Its material preferably is a durable commercial polymer, but may be made of aluminum alloys, or other materials and combinations. It can also be constructed by sheet-metal forming.

BLs for other types of firearm magazines, such as Kalashnikov, FAL, Galil, MP5, G36, or Uzi magazines, can be easily constructed by those skilled in the art under the present guidelines. Magazine compartment 30 should be shaped to fit and hold the magazine and provide open side grasping recesses. Slideway 14 and plunger 44 should be shaped according to the magazine's rounds and their maximum number for filling the magazine.

Operation—First Embodiment—FIGS. 1–3B

The BL provides substantial help to a firearm user by safely and rapidly assisting in complete magazine loading. It may be adapted to load any type of staggered magazine with any matching rounds.

Observing FIG. 1, and ignoring the magazine and rounds shown, a user first places an empty magazine in magazine compartment 30 by diagonally sliding the magazine's open end under bridge or limiter 36, and then lowering the rear end of the magazine into the compartment until it lays flat inside the compartment. Next, the user slides slider 40 away from the magazine until it reaches slideway stop 28.

FIG. 2A shows how to insert round(s) 50 in the slideway. With the BL on a bench or table, and slideway 14 empty, the user takes at least one loose round in each hand. Each round is then held horizontal and angled, relative to the length of the slideway, and is lowered between sidewalls 16 and 20 to reach its bottom supports 24 and 26. The round is then turned slightly CW to be perpendicular to the length of the slideway so that both its distal ends are in the grooves, and lie on the supports (see also FIG. 2B).

As the rounds are inserted and fit in the slideway, the user slides the rounds all the way toward the magazine (left) where they lie substantially parallel and side-by-side in the slideway (see FIG. 1). The leftmost round then touches the follower of the empty magazine (not shown).

A round fits in the grooves in just one position, i.e., the case rim fits in groove 22 and the tip of the bullet fits in groove 18 (see FIG. 2B). A round cannot fit in the opposite direction because the profile of groove 18 fits only the tip of the bullet and is not sized to accept the rim of a case. The same description applies when loading blank rounds, as shown in FIG. 2C.

When all the rounds are finally loaded in the slideway the user may visually inspect the rounds for defects and cleanness. The user inspects the rounds while sliding a finger across the rounds to roll them 360 degrees. The user may also use a dry brush to simultaneously roll and clean the rounds, or air pressure to blow any dust from the rounds.

Unlike prior-art loaders, more than 80% of the round (length of round less covered tip and rim) is exposed to the user when inspected prior to loading. If a faulty round is detected, it can be instantly replaced with another round by angling it and lifting it away.

Loading is achieved by holding handle 42 of the slider with, say, the right hand. The user places the left hand on the left edge of the BL. Now with a single quick right-hand stroke the user slides the slider toward the magazine, thrusting all the rounds into the magazine through its open end. As the rounds are pushed into the magazine, they compress its follower, which is spring loaded, in the usual fashion. The rounds enter the magazine successively. Stop 46 of the slider stops the plunger from entering the magazine. Thrusting takes a split second.

Back wall 34 of magazine compartment 30 acts as a stop and counter-resistance to the magazine as the rounds are thrust inside.

With all the rounds loaded in the magazine they will not be pushed out by the magazine's follower and spring because the magazine has retaining lips that keep the rounds inside.

The user next rearwardly and diagonally lifts the magazine away out of its compartment so that it can be used or stored. The BL is now ready to load another magazine.

With proper BL design, the rounds barely touch the lips of the magazine or its rear or front edges as they are thrust inside. This keeps the magazine intact.

Using the BL, fully loading a 30-round magazine takes less than 25 seconds, is a totally painless operation, and can be done repeatedly for hours. Further, the quick hand stroke of pushing all 30 rounds together produce a momentum that makes loading effortless.

Considering the operational simplicity of the BL, its small number of parts (three), its compact size, durability, and low weight, the BL provides a great benefit to the user with substantial improvements over prior-art loaders.

Figure 4A:
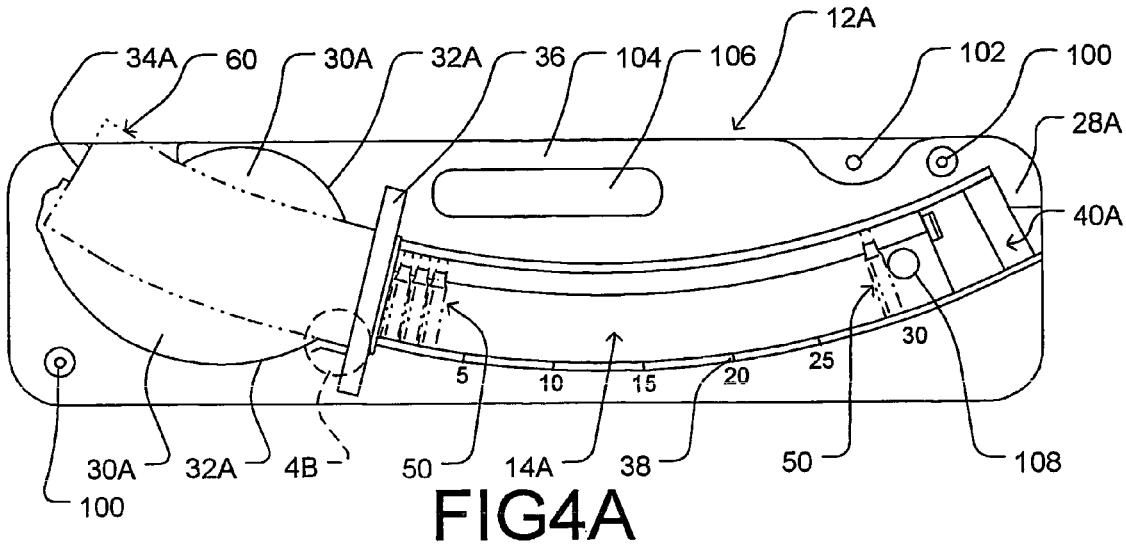
FIG. 4A shows a top view of a BL having an arched slideway.
Figure 4B:
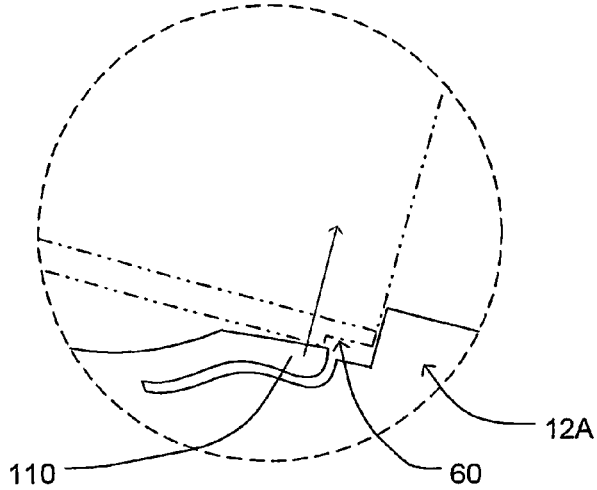
FIG. 4B shows an enlarged portion of FIG. 4A illustrating a magazine pusher.
Figure 4C:
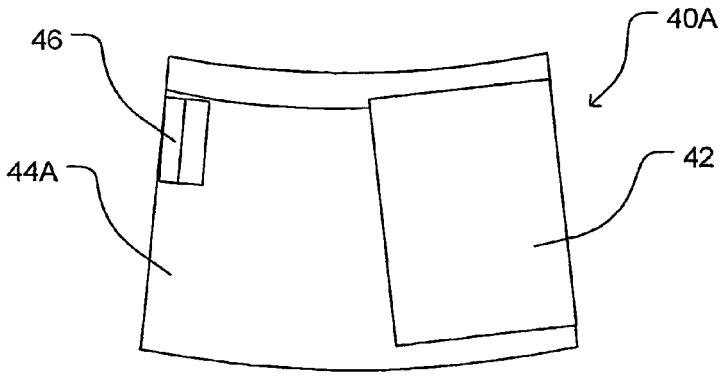
FIG. 4C shows a top view of an arched slider and plunger.

First Alternative Embodiment—FIGS. 4A–C—Arched Slideway

FIG. 4A shows a top view of an alternative BL body 12A having a similar construction and features as the BL of FIG. 1. However this BL includs an arched or curved slideway 14A. The arch or curve (radius) of the slideway is made to match the natural arch occurring when a group (say, thirty) of rounds are placed in a row, side-by-side, with all the bullets facing one direction, and are pressed together from one distal side, i.e., from the slider, until they form an arch. The arch forms because the cases are smaller at their bullet ends than at their rim ends.

The cross-section of arched slideway 14A is substantially the same as that of straight slideway 14 shown in FIG. 2B-C. The arched slideway includes arched sidewalls, grooves, and supports, and also an arched bottom.

Using a proper arched slideway reduces the internal forces acting from within the slideway by the rounds which tent to form an arch when pressed together. Also, such a slideway allows the rounds to enter the magazine parallel to its lips, as opposed to a straight slideway. Further, an arched slideway reduces the length of the BL. Therefore, BL body 12A with the arched slideway is presently the preferred BL embodiment.

The BL's magazine compartment 30A with its sidewalls 32A and back wall 34A is angled so the lips of a magazine in place will be perpendicular to the left edge of slideway 14A, i.e. parallel to the rounds in the slideway. Further, to reduce the width of the BL to a minimum, a corner of magazine 60 slightly extends out of the BL through an opening in sidewall 32A (shown at top left corner of FIG. 4A).

The BL of FIG. 4A further includes a securing hole 100, which enables the BL to be secured to a bench top by screws. A chain-securing hole 102 allows the BL to be tied by a chain. A carry handle 104 is provided by a through-cut void 106. A 30th round marker 108 is provided by a hole or depression just right of the 30th round. This allows a user to detect, in the dark, with a finger, whether a round is placed to the right of round 30.

Further, an alternative slideway stop 28A is a horizontal extension of main body 12A. Stop 28A closes and partially blocks slideway 14A at the far right.

FIG. 4B shows an enlarged portion of the BL of FIG. 4A, illustrating an optional magazine pusher 110. This pusher is a flexible spring tongue which is a part of the compartment. Also it can be a flexible metal insert, which engages, say, the back seam, or a different part, of the magazine and pushes it away so that the magazine is urged to the adjacent wall. This pusher allows comfortable placement, hold, and release of magazines of slightly varying dimensions.

FIG. 4C shows a top view of a slider 40A that has an arched or curved plunger 44A for fitting in the arched grooves of slideway 14A.

Operation of the BL with an arched slideway is the same as a BL having a straight slideway as shown and described for FIGS. 1–3B above.

Second Alternative Embodiment—FIGS. 5A–D—Adjustable Magazine Compartments

The following drawings and description of FIGS. 5A–D illustrate a portion of a BL showing an alternative magazine compartment 30B for securing magazines of various types, sizes, and/or geometries. These illustrate a compartment with various width adjusters and length adjusters.

Figure 5A:
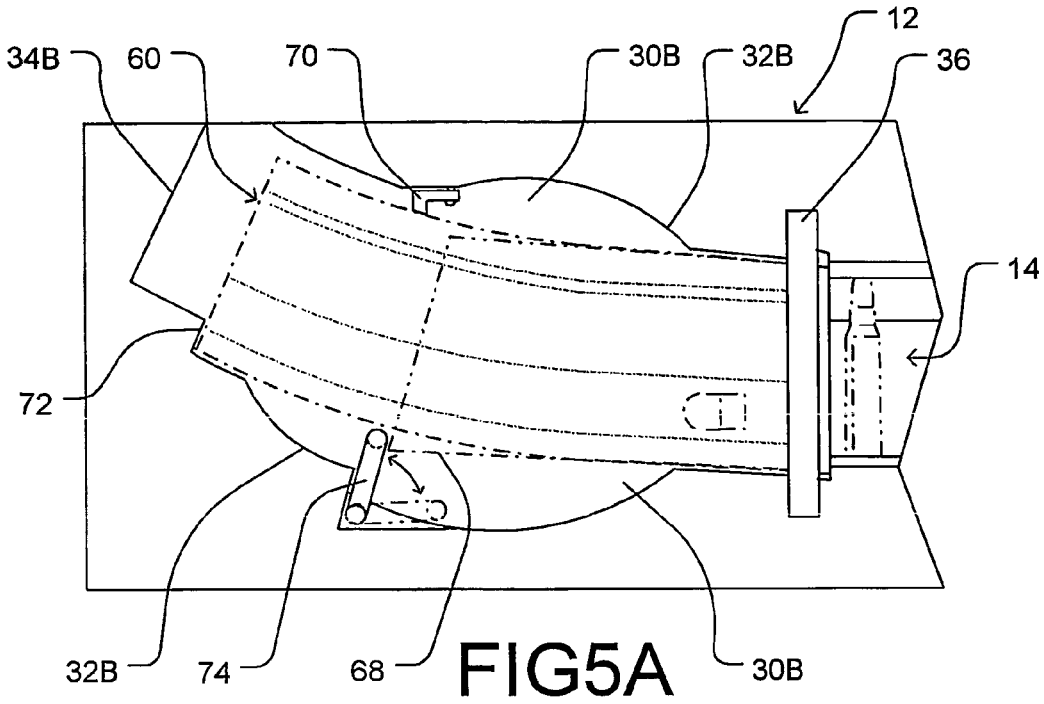
FIG. 5A shows a magazine compartment for various types of magazines with an AR15/M16 magazine installed.
Figure 5B:
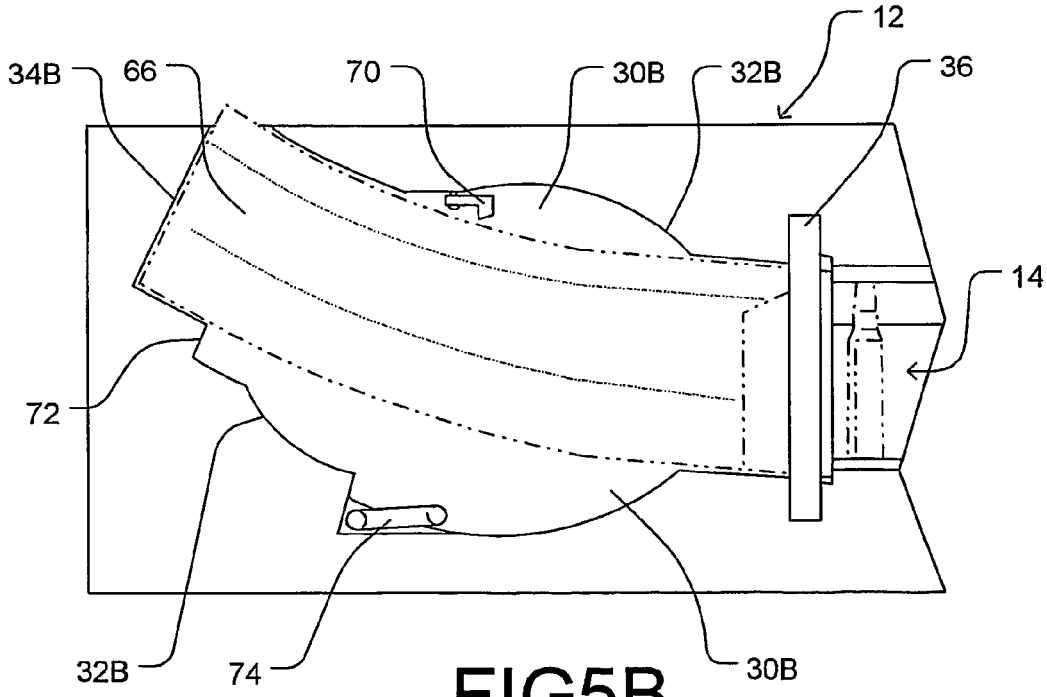
FIG. 5B shows the magazine compartment of FIG. 5A with a Galil-type magazine installed.
Figure 5C:
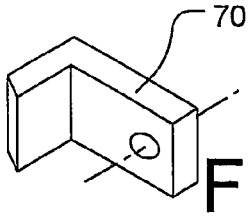
FIG. 5C shows a compartment width adjuster.
Figure 5D:
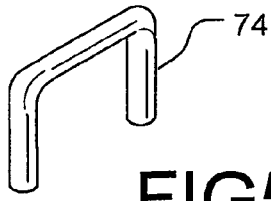
FIG. 5D shows a compartment length adjuster.

FIG. 5A shows a simplified top view of magazine compartment 30B with a width adjuster 70 (FIG. 5C), a first length adjuster 72, and a second length adjuster 74 (FIG. 5D). The illustrated compartment is adapted to receive a 30- or a 20-round AR15/M16 magazine, a 30-round Thermold or Orlite magazines, or a 35-round Galil-type magazine; all with the same round size. As these magazines vary in geometry and size, the compartment is made larger.

Width adjuster 70 is included for altering the inner width of the compartment to adjust for a particular magazine type. FIG. 5C illustrates width adjuster 70, which has a predominantly "L" shape where one of its sides is hinged by a pin (not shown) to sidewall 32B at a predetermined position so it can turn as required for compartment width adjustment. It may turn 180 degrees on the hinge, reducing the width at a first position, FIG. 5A, and increasing it at a second position, FIG. 5B. Width adjuster 70 is made of metal or plastic.

FIG. 5A shows magazine 60 being secured between sidewalls 32B, width adjuster 70, and by first length adjuster 72, which is a step-like portion of back wall 34B.

Alternatively, FIG. 5A also shows, in phantom lines, a 20 round AR15/M16 magazine 68 in the compartment. A second length adjuster 74 is shown engaging the magazine at its rear corner for blocking its back movement when loading rounds. In this example, the length adjuster it is made of a metal rod having a predominantly inverted "U" shape (FIG. 5D). One of its legs is hinged down in or adjacent the compartment at a predetermined position, while the other leg engages the magazine. It is limited in turning further counter—CW (CCW) than shown because it is blocked by a portion of sidewall 32B. It may be turned sideways (FIG. 5B) so not to disrupt when, for example, Thermold or Orlite magazines are used.

FIG. 5B shows the compartment of FIG. 5A, but with a 35-round Galil magazine 66 installed inside. Width adjuster 70 is shown turned about its hinge to allow the Galil magazine, being more curved, to fit in place. The magazine is now secured between sidewalls 32B and backwall 34B.

The user first sets width adjuster 70 and/or length adjuster 74 according to the geometry of the magazine at hand, by turning them either way. Then the user places the magazine in the compartment. Thereafter, the operation of a BL is the same as previously described.

Figure 6A:
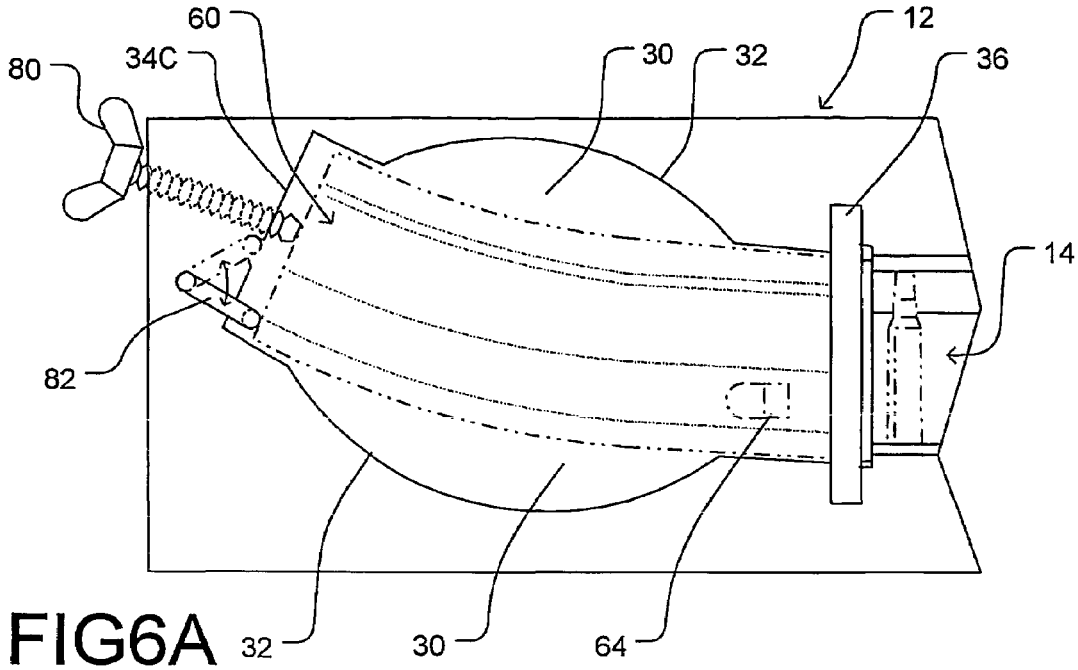
FIG. 6A shows a magazine compartment with two types of length adjusters.

Third Alternative Embodiment—FIG. 6A—Adjustable Magazine Compartment

FIG. 6A shows a top view of magazine compartment 30 with a third length adjuster 80 adapted to set the operative length of the compartment. Adjuster 80 can be a wing screw positioned horizontally through alternative back wall 34C, having an internal thread, to engage the rear end of the magazine.

Alternatively, FIG. 6A further shows a forth length adjuster 82 constructed similar to length adjuster 74 shown in FIG. 5D. Length adjuster 82 is hinged at one (rear) leg near backwall 34C and may be turned CCW to increase the operative length of the compartment, or be turned CW to decrease it, as shown.

When either length adjuster 80 or adjuster 82 are included, the user first sets either adjuster according to the length of the magazine at hand by screwing adjuster 80 either way, or by turning adjuster 82 either way, and then places the magazine into place. Thereafter, the operation of a BL is the same as previously described.

Figure 6B:
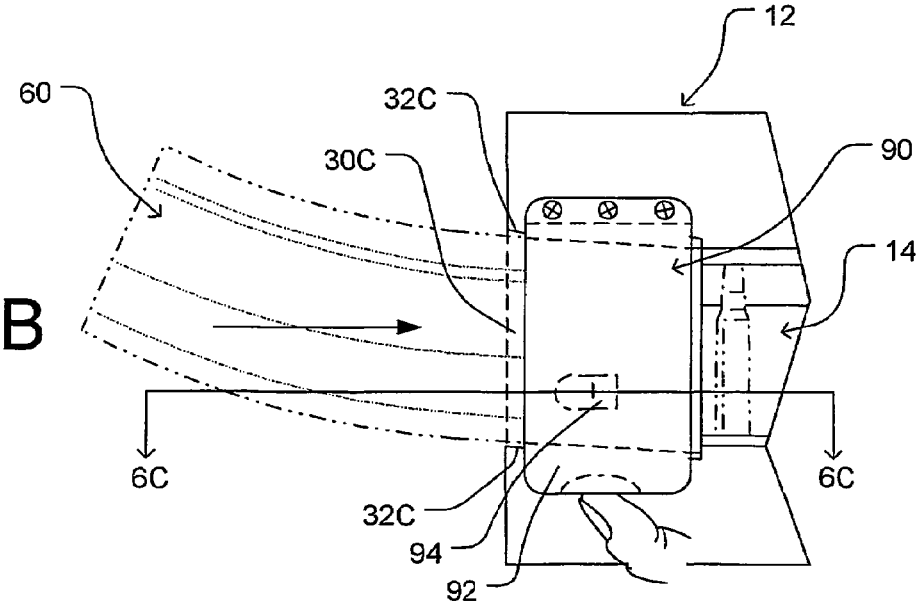
FIG. 6B shows a compartment with a magazine top lock mechanism.
Figure 6C:
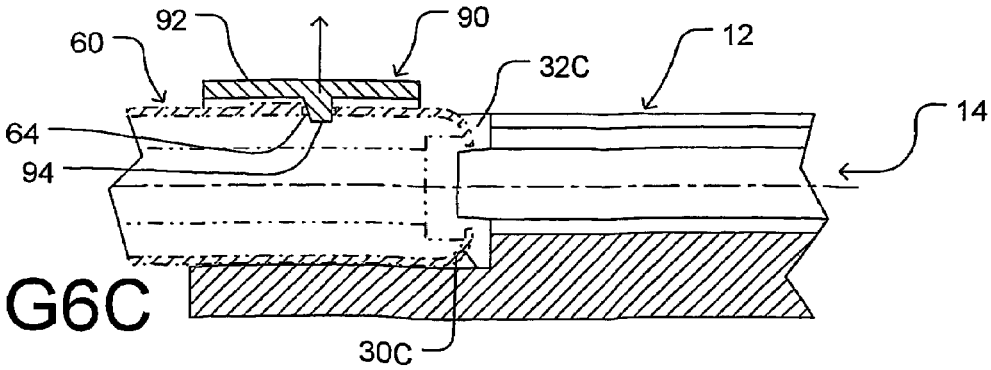
FIG. 6C shows a cut view portion of the top lock mechanism of FIG. 6B.

Fourth Alternative Embodiment—FIG. 6B-C—Compact Magazine Compartment

FIGS. 6B–C shows a top and side-cut view, respectively, portion of a BL with a compact magazine compartment 30C having sidewalls 32C and no back wall 34. The compartment is located at one end of the main body (left) and formed by a recess extending into the main body from a side surface (not numbered) of the main body and toward the slideway. The compartment is adapted to receive and hold only a portion of the magazine, specifically near its open end. The opposite rear end of the magazine freely extends out of the compartment, as shown in FIG. 6B.

A magazine lock mechanism 90 is located across and over the compartment. Mechanism 90 functions both as the bridge or limiter 36, previously described, and as a lock for the magazine. It may comprise a semi-flexible plate or tongue 92, secured along one of its edges to the upper surface of the main body (shown secured by, say, three screws at its top, not numbered), and further comprises a lock tooth or projection 94 at the underside of the plate. The tooth is sized and positioned to lock into the AR15/M16 magazine's lock hole or depression 64 when the magazine is inserted into the compartment (best shown in FIG. 6C). Mechanism 90 can also be an integral and inseparable part of the magazine compartment or main body when the BL is manufactured as, say, a one part or from two combined parts by, say, plastic injection molding, less the slider.

A magazine is inserted into place by pushing it horizontally, open end first, into compartment 30C through the side surface of the main body toward the slideway (see arrow direction in FIG. 6B) until lock tooth 94 clicks into the hole or depression 64 of the magazine. The magazine is now secured in the compartment and cannot move backward. Thereafter, the operation of the BL is the same as previously described.

A loaded magazine can be released by slightly lifting up flexible plate 92 at the opposite side where it is secured to the main body (shown done with a finger in FIG. 6B) for tooth 94 to momentarily disengage from hole or depression 64, while rearwardly pulling away the magazine.

Of course, a similar compartment and lock mechanism construction may be used for other magazines of different weapons.

Fifth Alternative Embodiment—7A–B—Compact Magazine Compartment

Figure 7A:
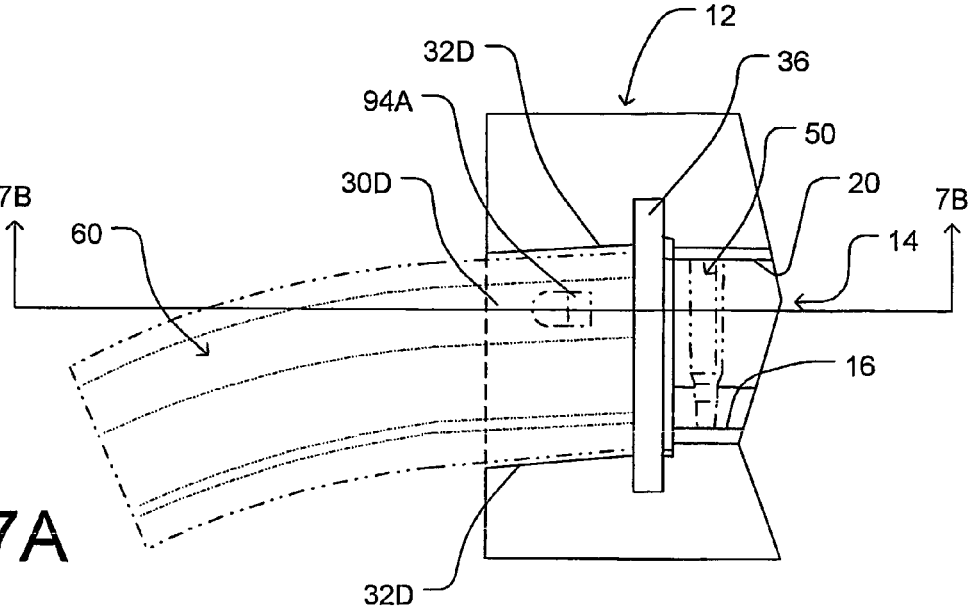
FIG. 7A shows a compartment with a bottom lock mechanism.

FIG. 7A shows a top view of a compact magazine compartment 30D having sidewalls 32D and no back wall. Again, the compartment is formed by a recess in the main body at one end of the main body (left) and is adapted to receive only a portion of magazine 60 around the magazine's open end. The magazine is now turned upside down from the previous orientations such that its lock hole or depression 64 faces down. Since the magazine is turned, the slideway is similarly changed to accommodate the opposite direction of rounds 50.

A magazine lock mechanism is located at the bottom of the compartment. It is an integral part of the compartment and includes a lock tooth 94A projecting upward from the bottom of the compartment (see FIG. 7B). It is sized and positioned to engage the lock hole or depression 64 of the magazine once installed.

Figure 7B:
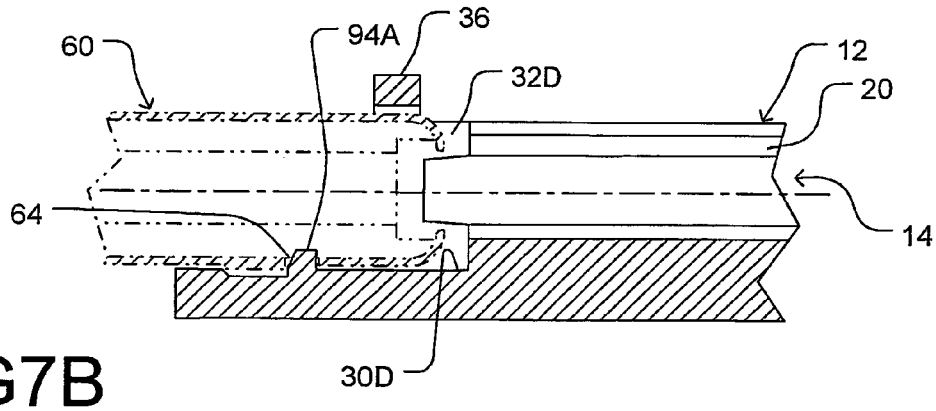
FIG. 7B shows a cut view portion of the bottom lock mechanism of FIG. 7A.

FIG. 7B shows a side cut view portion of lock tooth 94A entering lock hole or depression 64 of the magazine and holding it secure against horizontal movements. The magazine's mass keeps it down and in place. Alternatively a spring-like member extending from, say, bridge 36 (not shown) may be included for pressing down the magazine once it is installed.

A magazine is installed in place by lowering it diagonally, open end first, below the bridge toward the slideway, and then lowering its back side so the magazine is laid horizontally in the compartment. Lock tooth 94A then enters the hole or depression 64 of the magazine and secures the magazine to the BL for the load action. Thereafter, the operation of the BL is the same as previously described.

The magazine is released from the compartment by lifting its rear end upward so that its hole or depression will disengage from the tooth. Then it is pulled backward.

Sixth Alternative Embodiment—7C—Compact Magazine Compartment

Figure 7C:
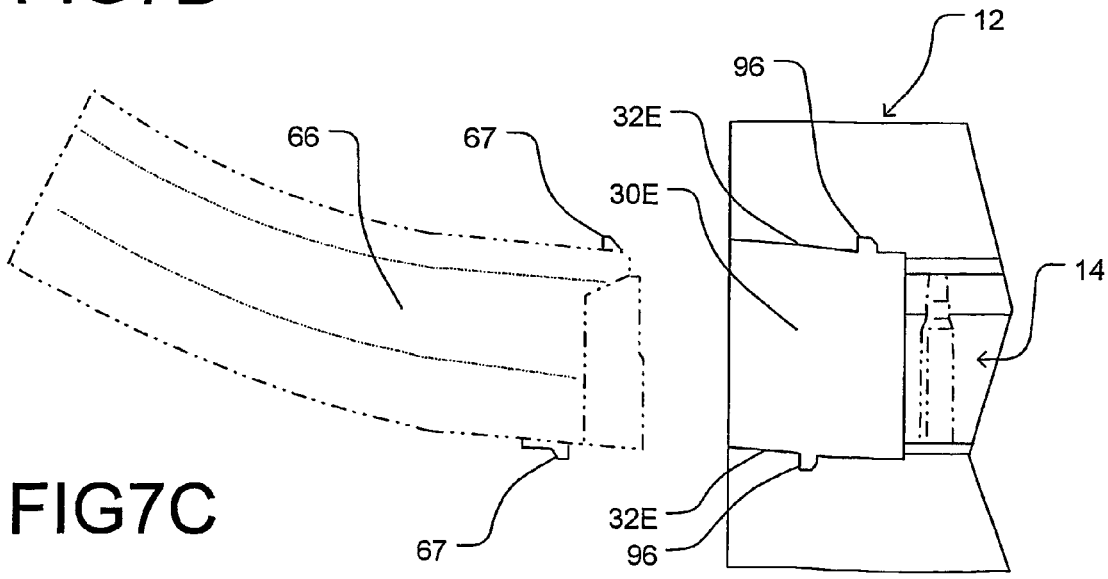
FIG. 7C shows a compartment with an integral magazine side lock mechanism.

FIG. 7C shows a top view of a compact magazine compartment 30E designed to receive and hold magazines with front and back lock protrusions 67 like the Galil magazine 66 shown, or like AK47 magazines. Again, the compartment is formed by a recess in the main body at one end of the main body (left) and is adapted to receive only a portion the magazine around the magazine's open end. Sidewalls 32E of compartment 30E include a magazine lock mechanism in the form of two lock recesses 96 extending down from the upper surface of the body and into sidewalls 32E, sized and located to receive protrusions 67 of the magazine, respectively.

A magazine is installed in place by lowering it diagonally, open end first, below the bridge, not shown, toward slideway 14 while protrusions 67 enter recesses 96 from the upper surface of the BL. Its rear side is then lowered so the magazine will lay horizontal. Once the magazine is in place it cannot move backward when loading because of the lock mechanism. Thereafter, the operation of the BL is the same as previously described.

The magazine is released from the compartment by lifting its rear side upward until the protrusions disengage from the recesses. Then it is pulled backward. The bridge may be eliminated if the magazine's mass is enough to make it stay in place when loading.

CONCLUSIONS, RAMIFICATION, AND SCOPE

The reader will see that we have provided a heavy-duty, simple and efficient device for quickly loading rounds into a magazine. It comprises three parts: a main body, a bridge and/or lock mechanism, and a slider. The BL provides comfort and safety to the user. It also provides an opportunity for military and law-enforcement agencies to save money on replacement of lips-damaged magazines caused by improvised, damaging, loading; and to save loading time at training or combat.

While the above description contains many specificities, these should not be construed as limitation on the scope of the invention, but rather as an exemplification of one preferred embodiment thereof adapted for a specific magazine type.

All numerical values provided are approximate, and may be changed to adapt to different magazines and/or round types and sizes.

The following are further examples of some but not all variations and ramifications:

The BL may be easily constructed to load any double-stack firearm magazines provided a suitable change in dimensions and geometry are made to the magazine compartment, slideway, and slider, as well as adjustments to the magazine locking mechanism if any.

All magazine compartments described above, including those of the alternative embodiments, are coupled and communicate with either a straight slideway (14, drawn for simplicity) or with an arched slideway (14A, preferable).

The bridge or limiter may be replaced by other limiters adapted to vertically limit the movement of the magazine's open side while the rounds are thrust into the magazine. As an example, two screws or the like with enlarged heads positioned close to the magazine's open side and partially above it, on either side of the magazine and bordering the slideway, can also act as a vertical limiter to the magazine. Further, back extension 37 and a similar extension on the bullet side may act also as the bridge or limiter 36 for doing the same. Still further, the bridge or limiter can be omitted altogether if the user presses down, with say the left hand, on the magazine as the rounds are thrust into the magazine, or if the magazine is heavy enough.

The BL can be operated and constructed for either left-handed or right-handed users by switching sides between the magazine compartment and the slideway. Further, a second magazine compartment may be added to a BL on the other side of the slideway for left-hand users too, and/or where the second compartment is adapted to receive another magazine types where the same rounds are used for both magazine types; the slider in this case will be slightly modified for having plungers on both sides of the handle. The BL will then increase in size but will load more magazine types.

Slider 40 may be without a handle where only the plunger is used.

Some modifications to the geometry and profile of the slideway and/or its sidewalls and bottom supports are possible (as the product matures and more experience is gained).

An expandable/retractable/collapsible/foldable slideway and/or compartment can be constructed to minimize the size of the BL. Further, the BL can be made to fold around hinges and/or can be constructed of a combination of separate parts connectable between them. As an example, a BL can be constructed of two separate parts: a magazine compartment and a slideway, both connected prior to use and separated after use for storage.

Further, a plurality of different magazine compartments for different magazine types can be manufactured as individual units. In parallel, a plurality of different slideways sections can be manufactured each adapted to receive different round type (5.56, 7.62, 9 mm etc., with different round length), as well as various matching sliders. Both the compartments and slideways will have connection members (say, male-to-female) for connecting a compartment with a matching slideway for an operative BL. Thus, prior to use, a user may assemble any combinations of BLs to fit his/her immediate loading needs.

Other means of adjusting the inner geometry and space of a compartment are possible as an alternative or addition to adjusters 70, 72, 74, 80, and 82. Further, adjusters to fit lower capacity magazines, of, say, 5, 10, 15 and 20 rounds, are also possible, by similar adjustment principles, or by new ones. Any of the movable adjusters shown may be also fixed not to be movable.

There exist certain instances where a single magazine length adjuster, as the fixed length adjuster 72 of FIG. 5A-B, may serve as a back magazine stop for more than one magazine.

A BL made of a plastic polymer is somewhat responsive to varying temperature and water absorption. Therefore, to widen the operating temperature range and/or reduce water absorption effects of a plastic BL, a metal insert(s) (or a special plastic polymer) may be added to replace BL plastic at crucial points, e.g., all or portions of the slideway. (Metals usually have a lower coefficient of linear thermal expansion than plastics). Also, flexible flange(s) may be added at crucial places to compensate for possible BL material expansion or contraction with temperature and humidity, and/or other environmental and surrounding variables. Further, providing cuts or voids at certain places in the BL, say at its underside, may compensate material variations and misalignments with temperature.

A more portable BL of lower weight and of smaller dimensions can be provided by reducing excess material around the slideway and magazine compartment, and from the underside of the BL.

A pneumatic cylinder with control can be used to push the slider or plunger to thrust the rounds.

A manual, semi-automatic, or an automatic feeding apparatus can be used in conjunction with the BL to feed rounds into the slideway. As an example, a rounds' funnel may be attached to the slideway where rounds are dropped inside, and possibly are oriented by a mechanism to point to the same direction, bullets adjacent bullets, and slide into the slideway from the funnel prior to loading through a, say, top opening in sidewalls 16 and 20. Then the slider is used as described above.

The BL may be adapted to operate vertically against a wall where the magazine compartment is, say, on the bottom and the slideway is vertically above it.

Accordingly, the scope of the invention should be determined, not by the embodiments illustrated, but by the appended claims and their legal equivalents.

We claim:

1. A loading device for loading a plurality of ammunition rounds or cartridges into a firearm magazine, said magazine comprising a substantially hollow body having a predetermined shape and size and an open end, said ammunition rounds each having a predetermined size and shape with a case end having a rim or flange, and a opposite bullet or slug end, said loading device comprising:

(a) an elongated body having an upper surface with a magazine recess or compartment at one end of said body which extends into said body from said upper surface, (b) said magazine recess having a predetermined shape and size for receiving and holding said firearm magazine, (c) said body having an elongated rounds recess or slideway at another end of said body extending into said body from said upper surface, (d) said elongated rounds recess communicating with said magazine recess, (e) said elongated rounds recess having a bottom and a pair of opposing sidewalls, (f) each of said sidewalls having at its top a protruding elongated projection, ledge, or rib so as to provide and partially define an elongated groove or recess on each sidewall under said elongated projection, (g) the groove on one sidewall being a case-holding groove and having a predetermined shape and size so that it can hold and slidingly guide said case ends of said plurality of said rounds when said case ends are stacked in said case-holding groove, (h) the groove on the opposite sidewall being a bullet-holding groove and having a predetermined shape and size so that it can hold and slidingly guide said bullet ends of said plurality of said rounds when said bullet ends are stacked in said bullet-holding groove, (i) said case-holding and bullet-holding grooves thus enabling said rounds to slide in and be captivated by said elongated rounds recess with said case and bullet ends in said case-holding and bullet-holding grooves, respectively, and (j) a slider or pusher having a plunger positioned in and extending between said case-holding and bullet-holding grooves, said plunger being shaped to fit in said case-holding and said bullet-holding grooves, such that said plunger can slide in said rounds recess, whereby when said magazine is placed in said magazine recess, a user can load it with said ammunition rounds quickly, easily, and safely by inserting said rounds in said rounds recess and moving said slider toward said magazine to force said rounds sequentially into said magazine, and said loading device has few parts, lighter weight, requires less handling time, and is more durable.

2. The device for loading ammunition rounds of claim 1, further including a bridge member extending across said magazine recess adjacent said rounds recess.

3. The device for loading ammunition rounds of claim 1 wherein said sidewalls, said projections, said grooves, and said bottom of said rounds recess are curved.

4. The device for loading ammunition rounds of claim 1 wherein said magazine recess has adjustment means for accommodating magazines of a plurality of sizes.

5. The device for loading ammunition rounds of claim 4 wherein said magazine recess adjustment means comprises a member which extends from a wall of said recess to a side of said magazine placed in said recess for firmly holding said magazine.

6. The device for loading ammunition rounds of claim 1 wherein said magazine recess has a pair of opposed sidewalls which each have a recess for facilitating manually inserting said magazine into and removing said magazine from said recess.

7. The device for loading ammunition rounds of claim 1 wherein said magazine recess has a flexible spring member extending from a wall thereof for urging said magazine against one side of said magazine recess to hold said magazine more securely.

8. A device for loading a plurality of ammunition rounds into a firearm magazine, said magazine comprising a substantially hollow body having a predetermined shape and size and an open end, said ammunition rounds each having predetermined size and shape with a case end having a rim or flange, and a opposite bullet or slug end, said device comprising:

(a) an elongated body having upper and side surfaces with a magazine recess or compartment extending into said body from one of said upper and side surfaces at one end of said body, (b) said magazine recess having a predetermined shape and size for receiving and holding at least a portion of said firearm magazine, (c) said body having an elongated rounds recess or slideway extending into said body from said upper surface of said body at another end of said body, (d) said elongated rounds recess communicating with said magazine recess, (e) said elongated rounds recess having a bottom and a pair of opposing sidewalls, (f) each of said sidewalls having at its top a protruding elongated projection, ledge, or rib so as to provide and partially define an elongated groove or recess on each sidewall under said elongated projection, (g) the groove on one sidewall being a case-holding groove and having a predetermined shape and size so that it can hold and slidingly guide said case ends of said plurality of said rounds when said case ends are stacked in said case-holding groove, (h) the groove on the opposite sidewall being a bullet-holding groove and having a predetermined shape and size so that it can hold and slidingly guide said bullet ends of said plurality of said rounds when said bullet ends are stacked in said bullet-holding groove, (i) said case-holding and bullet-holding grooves thus enabling said rounds to slide in and be captivated by said elongated rounds recess with said case and bullet ends in said case-holding and bullet-holding grooves, respectively, and (j) a slider or pusher having a plunger positioned in and extending between said case-holding and bullet-holding grooves, said plunger being shaped to fit in said case-holding and said bullet-holding grooves, such that said plunger can slide in said rounds recess, whereby when said magazine is placed in said magazine recess, a user can load it with said ammunition rounds quickly, easily, and safely by inserting said rounds in said rounds recess and moving said slider toward said magazine to force said rounds sequentially into said magazine, and said loading device has few parts, lighter weight, requires less handling time, and is more durable.

9. The device for loading ammunition rounds of claim 8 wherein said magazine recess extends into said body from said upper surface of said body at said one end of said body so that said magazine can be inserted into said magazine recess from said upper surface of said body.

10. The device for loading ammunition rounds of claim 8 wherein said magazine recess extends into said body from said side surface of said body at said one end of said body so that said magazine can be inserted into said magazine recess from said side surface of said body.

11. The device for loading ammunition rounds of claim 8, further including a magazine locking means for securing said magazine in said magazine recess.

12. The device for loading ammunition rounds of claim 8, further including a bridge member extending across said magazine recess adjacent said rounds recess.

13. The device for loading ammunition rounds of claim 8 wherein said sidewalls, said projections, said grooves, and said bottom of said rounds recess are curved.

14. The device for loading ammunition rounds of claim 8 wherein said slider includes a handle member attached and extending up from said plunger.

15. The device for loading ammunition rounds of claim 8 wherein said slider includes a stop for limiting travel of said plunger in said rounds recess.

16. The device for loading ammunition rounds of claim 8 wherein said rounds recess is calibrated to indicate the number of rounds that are stacked in said rounds recess.

17. The device for loading ammunition rounds of claim 8 wherein said body has a handle for enabling a person to pick up and carry said body.

18. A method of loading a plurality of ammunition rounds into a firearm magazine, said magazine comprising a substantially hollow body having a predetermined shape and size and an open end, said ammunition rounds each having predetermined size and shape and comprising at least a case having a rim or flange at a rear end thereof, and a opposite front end, comprising:

(a) providing an elongated body, (1) said elongated body having a magazine recess or compartment extending into said body from a one surface of said body, (2) said magazine recess located at one end of said body, (3) said magazine recess having a predetermined shape and size for receiving and holding at least a portion of said firearm magazine, (4) said body having an elongated rounds recess or slideway extending into said body from an upper surface of said body at another end of said body, (5) said elongated rounds recess communicating with said magazine recess, (6) said elongated rounds recess having a bottom and a pair of opposing sidewalls, (7) each of said sidewalls having at its top a protruding elongated projection, ledge, or rib so as to provide and partially define an elongated groove or recess on each sidewall under said elongated projection, (8) the groove on one sidewall being a case-holding groove and having a predetermined shape and size so that it can hold and slidingly guide said case ends of said plurality of rounds when said case ends are stacked in said case-holding groove, (9) the groove on the opposite sidewall being a front-end-holding groove and having a predetermined shape and size so that it can hold and slidingly guide said front ends of said plurality of said rounds when said front ends are stacked in said front-end-holding groove,

(10) said case-holding and front-end-holding grooves thus enabling said rounds to slide in and be captivated by said elongated rounds recess with said case and front ends in said case-holding and front-end-holding grooves, respectively, (b) providing a slider or pusher having a plunger positioned in said rounds recess and slideable therein, (c) inserting said magazine in said magazine recess and a plurality of rounds into said rounds recess so that said rounds are stacked in parallel in said rounds recess with their case ends in said case-holding groove and their front ends in said front-end-holding groove, and said slider is at the end of said rounds recess distal from said magazine, and (d) pushing said slider in said rounds recess toward said magazine so that it forces said plurality of said rounds into said magazine through said open end, whereby said magazine will be loaded with said rounds quickly, easily, and safely.

19. The method of loading ammunition rounds of claim 18 wherein said rounds have a bullet or slug in said front ends and wherein said front-end holding groove has a predetermined shape and size for holding a part of said bullets or slugs.

20. The method of loading ammunition rounds of claim 18 wherein said front-end-holding groove has a predetermined shape and size for holding a part of a front ends of blank or training rounds having crimped case ends.

21. The method of loading ammunition rounds of claim 18, further including a bridge member extending across said magazine recess adjacent said rounds recess.

22. The method of loading ammunition rounds of claim 18 wherein said sidewalls, said projections, said grooves, and said bottom of said rounds recess are curved.

23. The method of loading ammunition rounds of claim 18, further including a magazine locking means for securing said magazine in said magazine recess.

* * * * *